US010955193B2

(12) United States Patent
Miller

(10) Patent No.: US 10,955,193 B2
(45) Date of Patent: Mar. 23, 2021

(54) FURNACE FOR DENTAL PROSTHESIS OR PARTIAL DENTAL PROSTHESIS

(71) Applicant: DEKEMA DENTAL-KERAMIKÖFEN GMBH, Freilassing (DE)

(72) Inventor: Stephan Miller, Traunstein (DE)

(73) Assignee: Dekema Dental-Keramiköfen GmbH

( * ) Notice: Subject to any disclaimer, the term of this patent is extended or adjusted under 35 U.S.C. 154(b) by 474 days.

(21) Appl. No.: 15/578,181

(22) PCT Filed: May 12, 2016

(86) PCT No.: PCT/EP2016/060618

§ 371 (c)(1),
(2) Date: Jan. 16, 2018

(87) PCT Pub. No.: WO2016/198230

PCT Pub. Date: Dec. 15, 2016

(65) Prior Publication Data

US 2018/0149430 A1 May 31, 2018

(30) Foreign Application Priority Data

Jun. 9, 2015 (DE) ..... 20 2015 102 965.9

(51) Int. Cl.
*F27D 19/00* (2006.01)
*F27B 17/02* (2006.01)
(Continued)

(52) U.S. Cl.
CPC ..... *F27D 19/00* (2013.01); *F27B 17/025* (2013.01); *F27D 7/06* (2013.01); *F27D 11/00* (2013.01);
(Continued)

(58) Field of Classification Search
CPC ..... F27D 19/00; F27D 2019/0003; F27D 2019/0056; F27B 17/025; A61C 13/20
(Continued)

(56) References Cited

U.S. PATENT DOCUMENTS

2014/0120485 A1* 5/2014 Grunenfelder ..... F27D 21/00 432/32
2014/0236342 A1* 8/2014 Kettner ..... A61C 13/20 700/209
2014/0336805 A1* 11/2014 Brotzge ..... A61C 9/004 700/97

FOREIGN PATENT DOCUMENTS

DE 19753837 A1 6/1999
DE 19754077 A1 6/1999
(Continued)

OTHER PUBLICATIONS

Machine English Translation for DE 19824497 from Proquest Dialog accessed Feb. 12, 2020 (Year: 2020).*
(Continued)

*Primary Examiner* — Janie M Loeppke
(74) *Attorney, Agent, or Firm* — Dickinson Wright PLLC

(57) ABSTRACT

A furnace for a dental prosthesis or a partial dental prosthesis, in particular for dental ceramic, comprising a firing chamber which can be heated and in particular can also be evacuated, a control device for controlling the operation of the furnace on the basis of a firing program, which is based on a set of parameter values, and an operator control unit, which is assigned to the control device and is designed to display a representation of the firing program in the form of a firing process curve, wherein the operator control unit can be used in a simplified operating mode in which it displays
(Continued)

together with the firing process curve at least one operator control area for adjusting a selected parameter value of the set of parameter values that relates to a prescribed program phase of the firing program, wherein the at least one operator control area is permanently arranged in the area of the displayed firing process curve that corresponds to the prescribed program phase.

21 Claims, 3 Drawing Sheets

(51) Int. Cl.

| | |
|---|---|
| ***F27D 21/00*** | (2006.01) |
| ***F27D 7/06*** | (2006.01) |
| ***F27D 11/00*** | (2006.01) |
| ***F27D 21/04*** | (2006.01) |

(52) U.S. Cl.
CPC ..... *F27D 21/00* (2013.01); *F27D 21/04* (2013.01); *F27D 2007/066* (2013.01); *F27D 2019/0003* (2013.01); *F27D 2019/0056* (2013.01)

(58) Field of Classification Search
USPC ..... 219/413, 506
See application file for complete search history.

(56) References Cited

FOREIGN PATENT DOCUMENTS

| | | | | |
|---|---|---|---|---|
| DE | 19824497 | A1 * | 12/1999 | ..... F27B 17/025 |
| DE | 19824497 | A1 | 12/1999 | |
| EP | 1767168 | A1 | 3/2007 | |
| EP | 2058616 | A1 | 5/2009 | |
| EP | 2767255 | A1 | 8/2014 | |

OTHER PUBLICATIONS

Communication from European Patent Office regarding European Application No. 16721825.4 dated Dec. 3, 2018; 5 pages.
English Translation of International Search Report for related Application No. PCT/EP2016/060618; dated Jul. 8, 2016; 2 pages.
International Search Report for related Application No. PCT/EP2016/060618; dated Jul. 8, 2016; 3 pages.

* cited by examiner

FURNACE FOR DENTAL PROSTHESIS OR PARTIAL DENTAL PROSTHESIS

CROSS-REFERENCES TO RELATED APPLICATIONS

This application is a 371 National Phase Application of Patent Application PCT/EP2016/060618, filed on May 12, 2016, which claims the priority of German Application No. 202015102965.9 filed on Jun. 9, 2015, each of which is incorporated herein by reference, in its entirety.

The present invention relates to a furnace for dental prosthesis or partial dental prosthesis, in particular for dental ceramics, having a heatable firing chamber that is in particular also evacuable; having a control device for controlling the operation of the furnace with reference to a firing program that is based on a set of parameter values; and having an operating unit that is associated with the control device and that is configured to represent the firing program in the form of a firing progress curve.

Such furnaces are used, for example, in technical dental laboratories to subject firing objects of dental ceramic material to a predefined firing cycle. A number of types of firing cycles are known that differ with respect to the individual parameter values. A distinction is, for example, made between wash firing, dentin firing, stain firing and glaze firing. A user can fix the parameter values and thus the firing program by means of the operating unit, with the displayed firing progress curve providing an aid for the programming. The parameter values can, for example, be input or changed individually.

The programming of dental furnaces is a relatively demanding activity that is generally reserved to especially trained dental technicians. Dental furnaces are therefore predominantly used in the above-named special laboratories. However, endeavors are being made in the technical field to expand the usage options of programmable furnaces.

This object is satisfied by a furnace having the features of claim 1.

In accordance with the invention, the operating unit can be used in a simplified operating mode in which it displays, together with the firing progress curve, at least one control panel for adjusting a selected parameter value of the set of parameter values relating to a predefined program phase of the firing program, wherein the at least one control panel is fixedly arranged in that region of the displayed firing progress curve that corresponds to the predefined program phase.

A specific parameter—e.g. a parameter particularly important for a predefined application situation—can be adapted fast and intuitively via the control panel. Due to the self-explanatory representation, a user is directly aware of which program phase he is influencing by adjusting the parameter value. The operation of the furnace is thus particularly simple and comfortable. A furnace in accordance with the invention can in particular not only be operated by a specialist, but, for example, also by a dentist in his own practice. The invention is inter alia based on the recognition that it not at all necessary for many furnace applications to predefine all the existing parameter values at the user side. It is, for example, generally sufficient for stain firing and glaze firing only to adapt individual selected parameter values to the respective firing object.

The at least one control panel is preferably superposed on the firing progress curve. This allows a particularly fast and intuitive mental association of the parameter value with the respective program phase.

An embodiment of the invention provides that, in the simplified operating mode, the operating unit displays a plurality of control panels, preferably at most five control panels, for adjusting selected parameter values of the set of parameter values that are arranged in different regions of the firing progress curve. The flexibility of the operating unit is increased by the adjustability of a plurality of selected parameter values. The display of an excessive number of control panels—for example ten or more control panels—would, however, restrict the clarity of the display and thus the operating comfort.

A specific embodiment of the invention provides that, in the simplified operating mode, the operating unit displays a control panel for adjusting a heating rate and/or a control panel for adjusting a heating period that is arranged in the region of an upward slope in the firing progress curve. The user can quickly recognize that the respective control panel for adapting the heating process is provided. The displayed upward slope of the firing progress curve is preferably in a straight line for reasons of simplicity.

Alternatively or additionally, in the simplified operating mode, the operating unit can display a control panel for adjusting a final temperature and/or a control panel for adjusting a firing period that is arranged in the region of a plateau of the firing progress curve. It is easily recognizable for a user that the respective control panel serves for adapting the actual firing procedure. The displayed plateau is preferably in a straight line and extends horizontally.

It is preferred that, in the simplified operating mode, only the selected parameter value or the selected parameter values is/are adjustable while every other parameter value of the set of parameter values is set to a fixed default. To simplify the operation and to avoid operating errors, as many parameter values as possible are preferably set as fixed in advance.

A pre-drying time, a pre-drying temperature, a cooling period, a cooling rate and/or a cooling gradation can in particular be set to a fixed default in the simplified operating mode. It is generally not necessary to change these parameter values for many firing cycles such as stain firing and glaze firing.

It is preferred that the operating unit is provided for sole use in the simplified operating mode. A simple operability is always ensured with such a furnace. In general, however, the operating unit could also be changeable into an expanded operating mode; for example by actuating a specific additional control panel in which further parameter values, in particular all the parameter values of the set of parameter values, can be adjusted.

Provision can be made that the operating unit comprises a touch-sensitive screen and preferably does not have any further display and operating elements. The operating unit can in particular be designed completely as a touchscreen. The control panel in such an embodiment is particularly advantageously combinable with the representation of the firing progress curve.

An embodiment of the invention provides that the operating unit is integrated in the furnace. The operating unit can, for example, be arranged at a base housing of the furnace. Such an embodiment is particularly compact.

Alternatively, the operating unit can be designed as a portable unit separate from the furnace, for example as a tablet computer. The operating comfort is particularly high here.

The at least one control panel can be a display field which shows the currently selected parameter value and by whose taping an input window can be invoked. This enables a particularly intuitive operation.

The input window can have two levels, with the second level being invokable by tapping the first level. Expanded input options are thereby provided.

The first level of the input window can in particular comprise a control dial or a slide control and the second level can comprise a key panel. The first level here enables a simple and fast adaptation of the current parameter value while the second level enables a direct input of a desired parameter value as required.

A further embodiment of the invention provides that the operating unit is configured for displaying at least one functional control panel which is independent of the representation of the firing progress curve and via which an operating function of the furnace can be triggered, in particular the starting and stopping of the firing program, the switching on and off of an evacuation apparatus and/or the moving up and down of an object carrier lift. The most important basic control functions of the furnace and the adaptation of the firing program are thus combined in a common control screen.

A further embodiment of the invention provides that the operating unit is configured for displaying at least one setting control panel which is independent of the representation of the firing progress curve and via which at least one input window is invokable to adapt basic settings of the operating unit and/or a calibration of the furnace. The setting control panel can be designed as a self-explanatory icon, e.g. in the form of a stylized tool representation.

The operating unit can furthermore be configured for displaying the furnace temperature, the outer temperature and/or the time in respective display fields. The user can thus quickly detect the current operating state of the furnace at any time.

The operating unit can comprise an electronic interface for a barcode reader or a QR code reader via which parameter values of the set of parameters can be read into the control device. The operating comfort is hereby further increased.

The invention also relates to an operating unit of a furnace for dental prosthesis or partial dental prosthesis, in particular for dental ceramics, that comprises a heatable firing chamber that is in particular also evacuable, and a control device for controlling the operation of the furnace using a firing program that is based on a set of parameter values, wherein the operating unit is associated with the control device and is configured to display a representation of the firing program in the form of a firing curve.

In accordance with the invention, the operating unit can be used in a simplified operating mode in which it displays, together with the firing progress curve, at least one control panel to adjust a selected parameter value of the set of parameter values relating to a predefined program phase of the firing program, wherein the at least one control panel is fixedly arranged in that region of the displayed firing progress curve that corresponds to the predefined program phase.

Further developments of the invention are also set forth in the dependent claims, in the description and in the enclosed drawings.

The invention will be described in the following by way of example with reference to the drawings.

Figure 1:
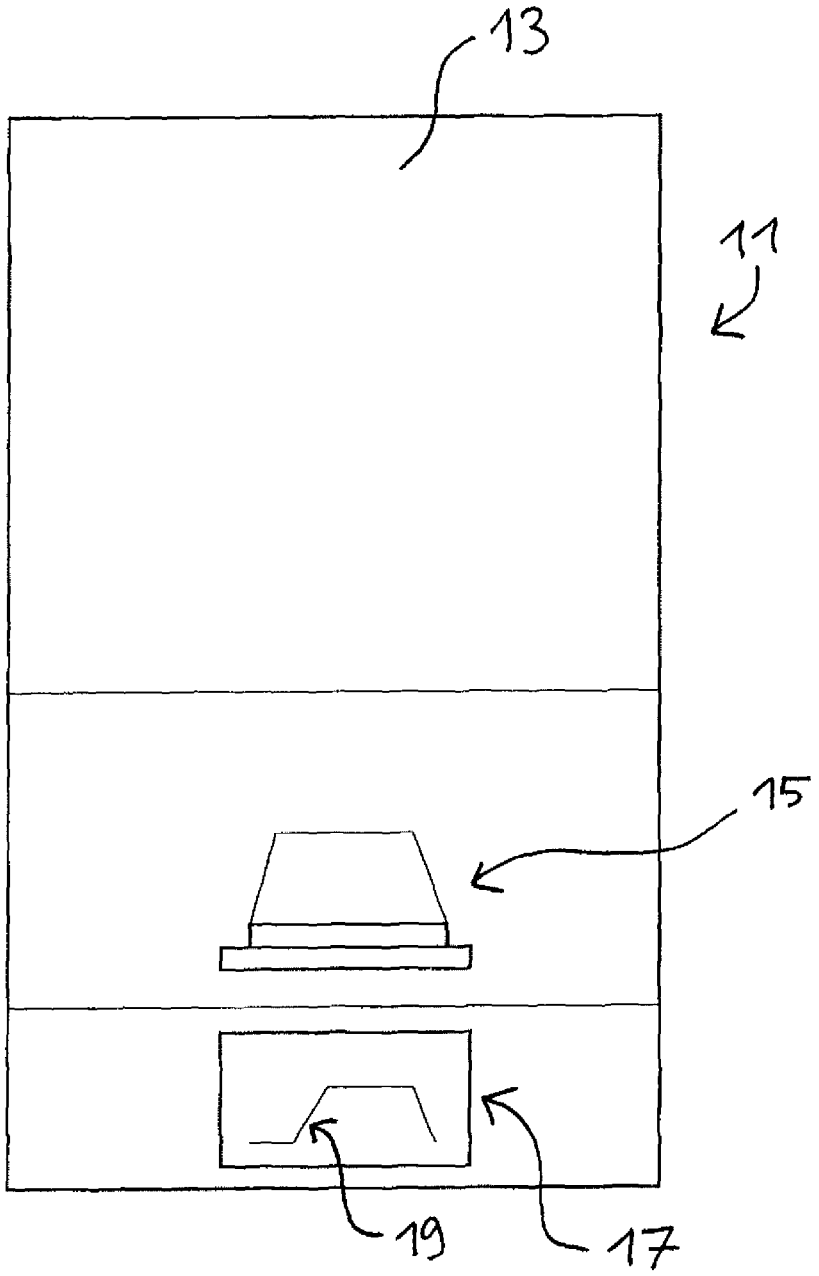
FIG. 1 shows in a simplified form a furnace in accordance with a first embodiment of the invention.

The furnace 11 for dental ceramics shown in FIG. 1 comprises a housing 13 in which a firing chamber is accommodated that is not visible from the outside. The firing chamber is heatable in a generally known manner via heating elements likewise not visible in FIG. 1 and is evacuable by means of a vacuum pump as required. A firing object can be moved from below into the firing chamber and can be moved downward out of the firing chamber by means of a liftable and lowerable object carrier lift 15. An electronic control device (not shown) is also accommodated in the housing 13 for controlling the operation of the furnace 11 using a firing program. The firing program is based in a typical manner on a set of parameter values such as on the pre-drying time, the pre-drying temperature, the heating rate, the final temperature, the cooling period, and the cooling rate.

The operation of the furnace 11 takes place via an operating unit 17 that is associated with the electronic control device and that is directly integrated into the housing 13 of the furnace 11 in the embodiment shown in FIG. 1. The operating unit 17 is here formed only by a touchscreen. In general, however, separate single operating elements could be present, for example, in addition to the touchscreen. The operating unit 17 is configured to display a representation of the firing program in the form of a firing progress curve 19 in an operating state of the furnace 11.

Figure 2:
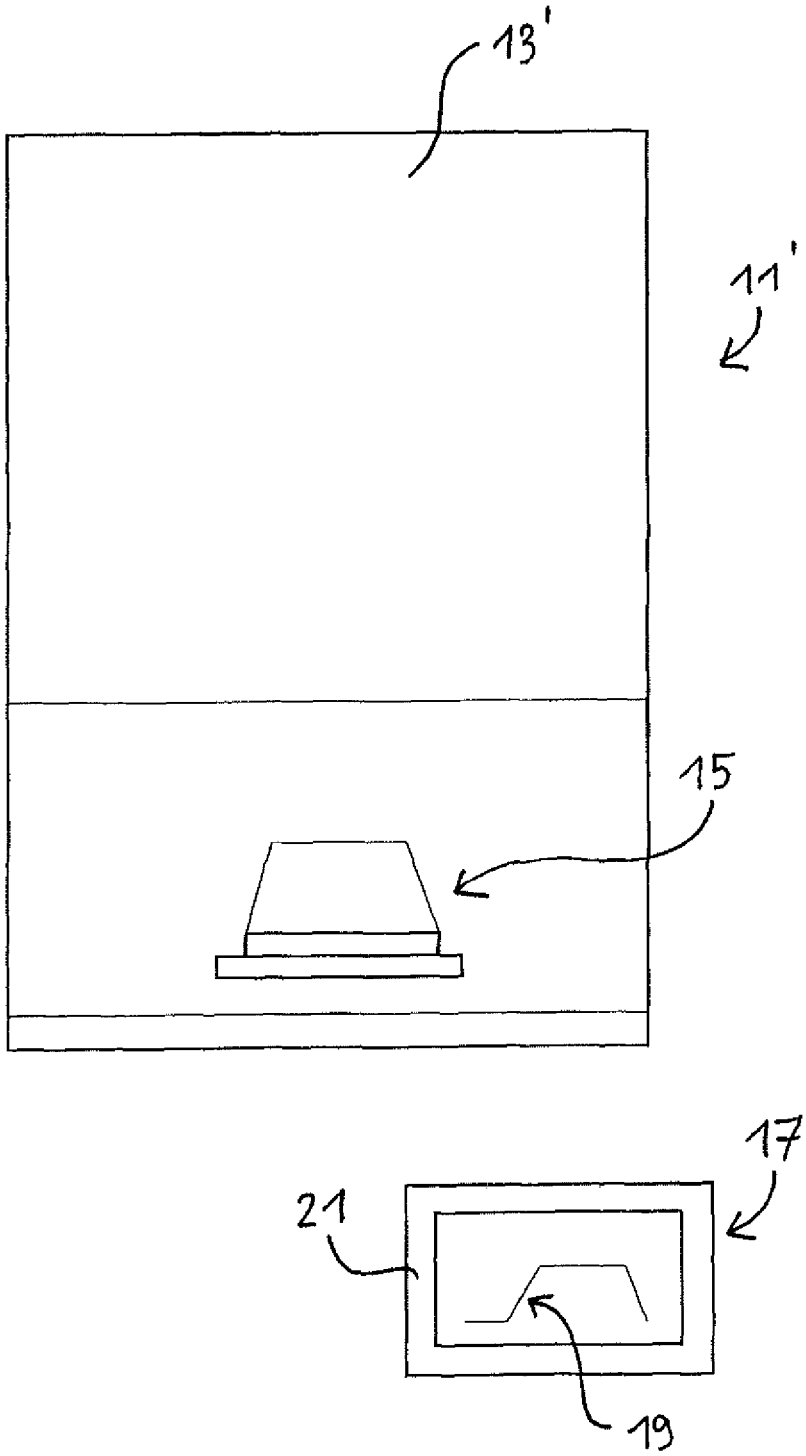
FIG. 2 shows a furnace in accordance with a second embodiment of the invention.

The furnace 11' shown in FIG. 2 is in principle of a similar design to the above-described furnace 11, but with the operating unit 17 of the furnace 11' not being integrated in its housing 13', but rather being designed as a portable unit separate from the furnace 11'. The operating unit 17 is especially integrated in a table computer 21 that is connected to the control device of the furnace 11' via a cableless communication connection.

Figure 3:
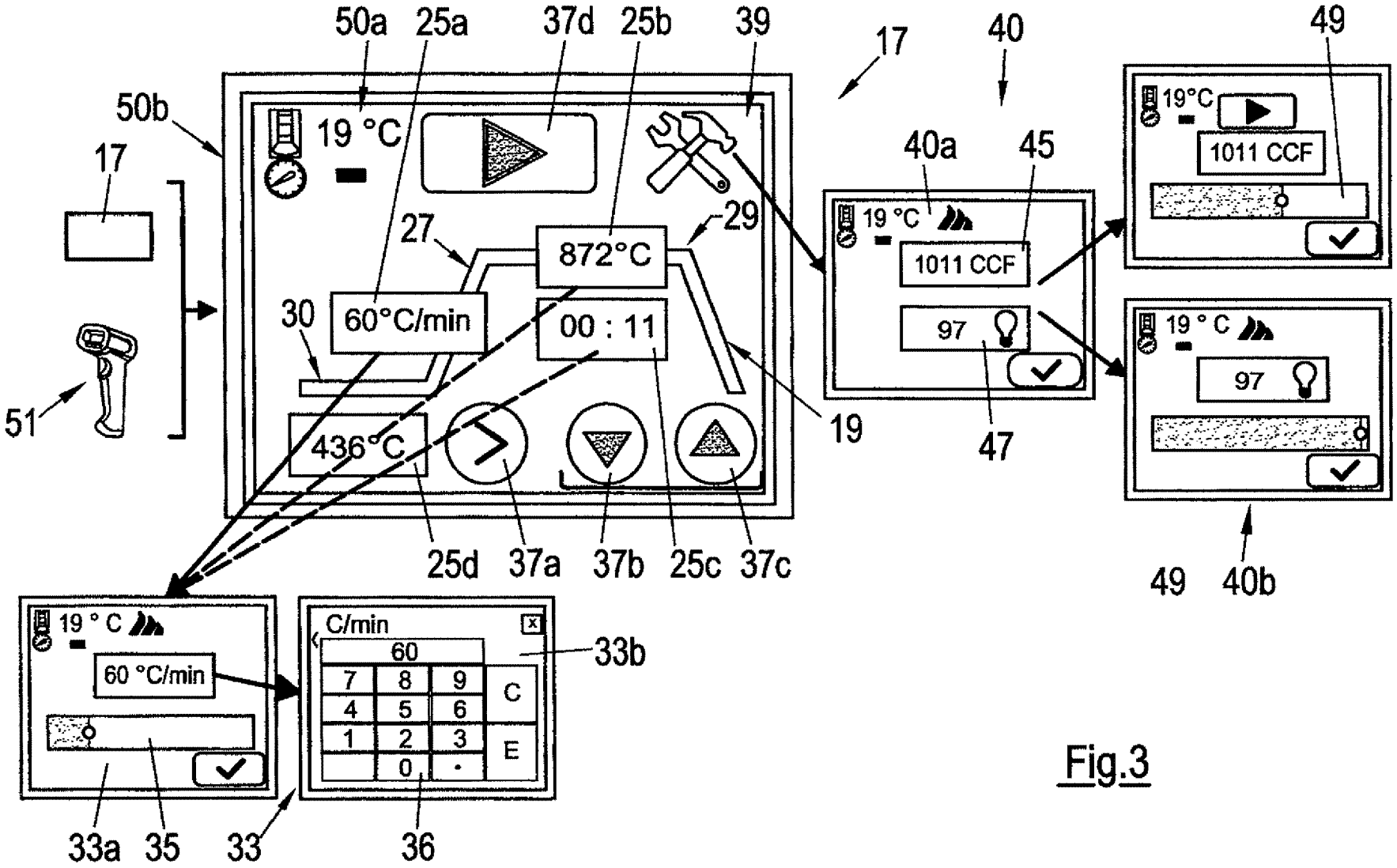
FIG. 3 shows an operating unit in accordance with the invention for a furnace.

So that the furnaces 11, 11' shown in FIGS. 1 and 2 can also be used by those users who have not been especially trained, they are deliberately kept relatively simple in a construction respect. In addition, the operating unit 17 is usable in a simplified operating mode both in the furnace 11 in accordance with FIG. 1 and in the furnace 11' in accordance with FIG. 2, as will be described in more detail in the following with reference to FIG. 3.

In the simplified operating mode, the operating unit 17 shows, together with the firing progress curve 19, four control panels 25*a-d* for adjusting respective selected parameter values of that set of parameter values that the firing program lays down. As shown, the control panels 25*a-d* are arranged in different regions of the firing progress curve 19 and are partly superposed thereon. The respective current parameter values are displayed in the control panels 25*a-d*.

The parameter values adjustable by means of the control panels 25*a-d* each relate to a specific predefined program phase of the firing program. To facilitate the operation, each control panel 25*a-d* is fixedly arranged in that region of the displayed firing progress curve 19 that corresponds to the predefined program phase. Specifically, one control panel 25*a* for adjusting the heating rate is arranged in the region of an upward slope 27 of the firing progress curve 19 while another control panel 25*b* for adjusting the final temperature is arranged in the upper region of an upper plateau 29 of the firing progress curve 19. A control panel 25*c* for adjusting the firing period is arranged beneath the control panel 25*b* for adjusting the final temperature. In addition, a further control panel 25*d* for adjusting the base temperature is arranged beneath a lower plateau 30 of the firing progress curve 19.

The remaining parameter values that are decisive for a firing cycle such as the pre-drying time, the pre-drying temperature, the cooling period, the cooling rate, and the cooling gradation are not adjustable in the simplified operating mode of the operating unit 17, but are rather set to fixed defaults. The control panels 25*a-d* each have to be tapped to adjust the selected parameter values. A respective input window 33 is invoked by such a tap and has, as shown in the bottom left part of FIG. 3, a first level 33*a* and a second level 33*b*. The first level 33*a* here comprises, in addition to a display of the parameter value, a slide control 35 while the second plane 33*b* comprises a key panel 36. It preferably applies to each control panel 25*a-d* that the first level 33*a* of the input window 33 is invokable by a single tap and the second level 33*b* of the input window 33 is invokable by a second tap.

Three functional control panels 37*a-c* are located beneath the firing progress curve 19 and are independent of the representation of the firing progress curve 19. The functional control panel 37*a* at the left in the drawing is marked by an arrow facing to the right and serves for the switching on and off of an evacuation apparatus, not shown. The two functional control panels 37*b*, 37*c* disposed at the right in the drawing serve for the moving up and down of the object carrier lift 15 (FIGS. 1 and 2) and are marked by arrows accordingly. A further functional control panel 37*d* is arranged above the firing progress curve 19; it serves for starting and stopping the firing program and is accordingly marked by a start symbol (as shown) and by a stop symbol (not shown)—for example a solid square.

A setting control panel 39 is arranged at the right in the drawing next to the functional control panel 37*d* and an input window 40 for adapting base settings of the operating unit 17 and a calibration of the furnace 11, 11' is invokable via it. On a tapping of the setting control panel 39 marked by tool symbols, a first level 40*a* of the input window 40 is first invoked. A calibration display field 45 and a brightness display field 47 are shown in the first plane 40*a* of the input window 40. The calibration display field 45 serves for the display of calibration settings while the brightness display field 47 displays the currently set screen brightness. The second level 40*b* of the input window 40 comprises two different input windows depending on whether the calibration display field 45 or the brightness display field 47 was tapped in the first level 40*a*. The settings for the calibration of the furnace 11, 11' and for the screen brightness of the operating unit 17 can be changed in the second level 40*b* by means of respective slide controls 49.

The room temperature and the current time are displayed in respective display fields 50*a,b* in the upper left region of the operating unit 17. It is understood that these display fields 50*a-c* can also be arranged at different points of the operating unit 17.

The operating unit 17 comprises an electronic interface, not shown, for a barcode reader 51 via which parameter values of the set of parameter values can be read into the control device of the furnace 11, 11'. This electronic interface is preferably also able to communicate with a further operating unit 17, only shown schematically, of a furnace 11, 11.

To ensure an operation of the furnace 11, 11' that is always simple, the operating unit 17 is preferably provided for sole use in the simplified operating mode. An accidental change into a more complicated operating mode is thus precluded. It can, however, be desirable for specific applications to enable a change of the operating unit 17 into an expanded operating mode in which the user has access to all the parameter values of the set of parameter values.

REFERENCE NUMERAL LIST

11, 11' furnace
13, 13' housing
15 object carrier lift
17 operating unit
19 firing progress curve
21 tablet computer
25*a-d* control panel
27 upward slope
29 upper plateau
30 lower plateau
33 input window
33*a* first level
33*b* second level
35 slide control
36 key panel
37*a-d* functional control panel
39 setting control panel
40 input window
40*a* first level
40 second level
45 calibration display field
47 brightness display field
49 slide control
50*a,b* display field
51 barcode reader

The invention claimed is:

1. A furnace (11, 11') for dental prosthesis or partial dental prosthesis, having a heatable and evacuable firing chamber; having a control device for controlling the operation of the furnace (11, 11') with reference to a firing program that is based on a set of parameter values; and having an operating unit (17) formed by a touchscreen that is associated with the control device and that is configured to represent the firing program in the form of a firing progress curve (19), wherein the operating unit (17) is usable in a simplified operating mode in which it displays on the touchscreen, together with the firing progress curve (19), at least one control panel (25*a-d*) for adjusting a selected parameter value of the set of parameter values relating to a predefined program phase of the firing program, with the at least one control panel (25*a-d*) being fixedly arranged and superposed in that region of the displayed firing progress curve (19) that corresponds to the predefined program phase to allow the predefined program phase to be changed by tapping the respective at least one control panel (25*a-d*) superposed along the firing progress curve (19) on the touchscreen.

2. A furnace in accordance with claim 1, wherein, in the simplified operating mode, the operating unit (17) displays a plurality of control panels for adjusting selected parameter values of the set of parameter values that are arranged in different regions of the firing progress curve (19).

3. A furnace in accordance with claim 2, wherein the plurality of control panels does not exceed five control panels.

4. A furnace in accordance with claim 1, wherein, in the simplified operating mode, the operating unit (17) displays a control panel (25*a*) for at least one of adjusting a heating rate and a control panel for adjusting a heating period that is arranged in an upward slope (27) of the firing progress curve (19).

5. A furnace in accordance with claim 1, wherein, in the simplified operating mode, the operating unit (17) displays at least one of a control panel (25*b*) for adjusting a final temperature and a control panel (25*c*) for adjusting a firing period that is arranged in the region of a plateau (29) of the firing progress curve (19).

6. A furnace in accordance with claim 1, wherein, in the simplified operating mode, only the or each selected parameter value is adjustable while every other parameter value of the set of parameter values is set to a fixed default.

7. A furnace in accordance with claim 6, wherein, in the simplified operating mode, at least one of a pre-drying time, a pre-drying temperature, a cooling period, a cooling rate and a cooling gradation is set to a fixed default.

8. A furnace in accordance with claim 1, wherein the operating unit (17) is provided for exclusive use in the simplified operating mode.

9. A furnace in accordance with claim 1, wherein the operating unit does not have any further display and operating elements.

10. A furnace in accordance with claim 1, wherein the operating unit (17) is integrated in the furnace (11).

11. A furnace in accordance with claim 1, wherein the operating unit (17) is designed as a portable unit (21) separate from the furnace (11').

12. A furnace in accordance with claim 11, wherein the operating unit is a tablet computer.

13. A furnace in accordance with claim 1, wherein the at least one control panel (25*a-d*) is a display field which shows the current selected parameter value and is adapted to call up an input window (33) by being tapped.

14. A furnace in accordance with claim 13, wherein the input window (33) has two levels (33*a*, 33*b*), and the second level (33*b*) can be called up by tapping the first level (33*a*).

15. A furnace in accordance with claim 14, wherein the first level (33*a*) of the input window (33) comprises one of a control dial and a slide control (35) and the second level (33*b*) comprises a key panel (36).

16. A furnace in accordance with claim 1, wherein the operating unit (17) is configured for displaying at least one functional control panel (37*a-d*) independent of the representation of the firing progress curve (19), via which functional control panel an operating function of the furnace (11, 11') can be triggered.

17. A furnace in accordance with claim 16, wherein the operating function comprises at least one of the starting and stopping of the firing program, the switching on and off of an evacuation apparatus and the moving up and down of an object carrier lift (15).

18. A furnace in accordance with claim 1, wherein the operating unit (17) is configured for displaying at least one setting control panel (309) independent of the representation of the firing progress curve (19), via which setting control panel at least one input window (40) can be called up for adapting at least one of base settings of the operating unit (17) and a calibration of the furnace (11, 11').

19. A furnace in accordance with claim 1, wherein the operating unit (17) is configured for displaying at least one of the furnace temperature, the outside temperature and the time in respective display fields (50*a*, 50*b*).

20. A furnace in accordance with claim 1, wherein the operating unit (17) comprises one of an electronic interface for a barcode reader (51) and a QR code reader via which parameter values of the set of parameters can be read into the control device.

21. An operating unit (17) of a furnace (11, 11') for dental prosthesis or partial dental prosthesis, that comprises a heatable and evacuable firing chamber and a control device for controlling the operation of the furnace (11, 11') using a firing program that is based on a set of parameter values, wherein an operating unit (17) formed by a touchscreen is associated with the control device and is configured to display a representation of the firing program in the form of a firing curve (19), wherein the operating unit (17) is usable in a simplified operating mode in which it displays on the touchscreen, together with the firing progress curve (19), a plurality of control panels (25*a-d*) for adjusting a selected parameter value of the set of parameter values relating to a predefined program phase of the firing program by tapping the touchscreen on the control panel associated with the predefined program phase to be changed, with the plurality of control panels (25*a-d*) being fixedly superposed along separate regions of the displayed firing progress curve that correspond to respective predefined program phases of the firing progress curve (19).

* * * * *